United States Patent [19]

Bessouat et al.

[11] 4,250,841

[45] Feb. 17, 1981

[54] DEVICE FOR DRYING AND SUPERHEATING STEAM

[75] Inventors: Roger Bessouat; Jacques Marjollet, both of Paris; Gérard Palacio, Montmorency, all of France

[73] Assignee: Societe Anonyme dite: Stein Industrie, Velizy-Villacoublay, France

[21] Appl. No.: 32,805

[22] Filed: Apr. 24, 1979

[30] Foreign Application Priority Data

Apr. 28, 1978 [FR] France ..... 78 12634

[51] Int. Cl.[3] ..... F22G 1/00; F28F 9/22

[52] U.S. Cl. ..... 122/483; 165/110; 165/161

[58] Field of Search ..... 122/479 D, 488, 489, 122/491, 492, 459, 460, 469, 476, 478, 483; 165/110, 161

[56] References Cited

U.S. PATENT DOCUMENTS

| | | | |
|---|---|---|---|
| 1,897,722 | 2/1933 | Hughes et al. | 122/491 |
| 3,411,486 | 11/1968 | Cooper | 122/476 |
| 4,143,619 | 3/1979 | Marjollet et al. | 122/483 |

FOREIGN PATENT DOCUMENTS

| | | | |
|---|---|---|---|
| 423309 | 12/1923 | Fed. Rep. of Germany | 122/479 |

*Primary Examiner*—Anthony V. Ciarlante

*Attorney, Agent, or Firm*—Sughrue, Rothwell, Mion, Zinn and Macpeak

[57] ABSTRACT

The device includes inside a cylindrical casing with a horizontal axis and parallel to said axis and symmetrical about the longitudinal plane of symmetry:

a. in its lower portion, a pair of separator devices which remove the water from the water and steam emulsion which is to be superheated;

b. in its upper portion, a pair of detachable nests of tubes which constitute the superheaters; and c. members forming channels which allow part of the water and steam emulsion to rise on either side of the separators and of the superheaters near the inside surface of the casing, then to drop back between them to enter the inlets of the separators near to the plane of symmetry.

Application to supplying a high-power turbine with superheated steam.

2 Claims, 1 Drawing Figure

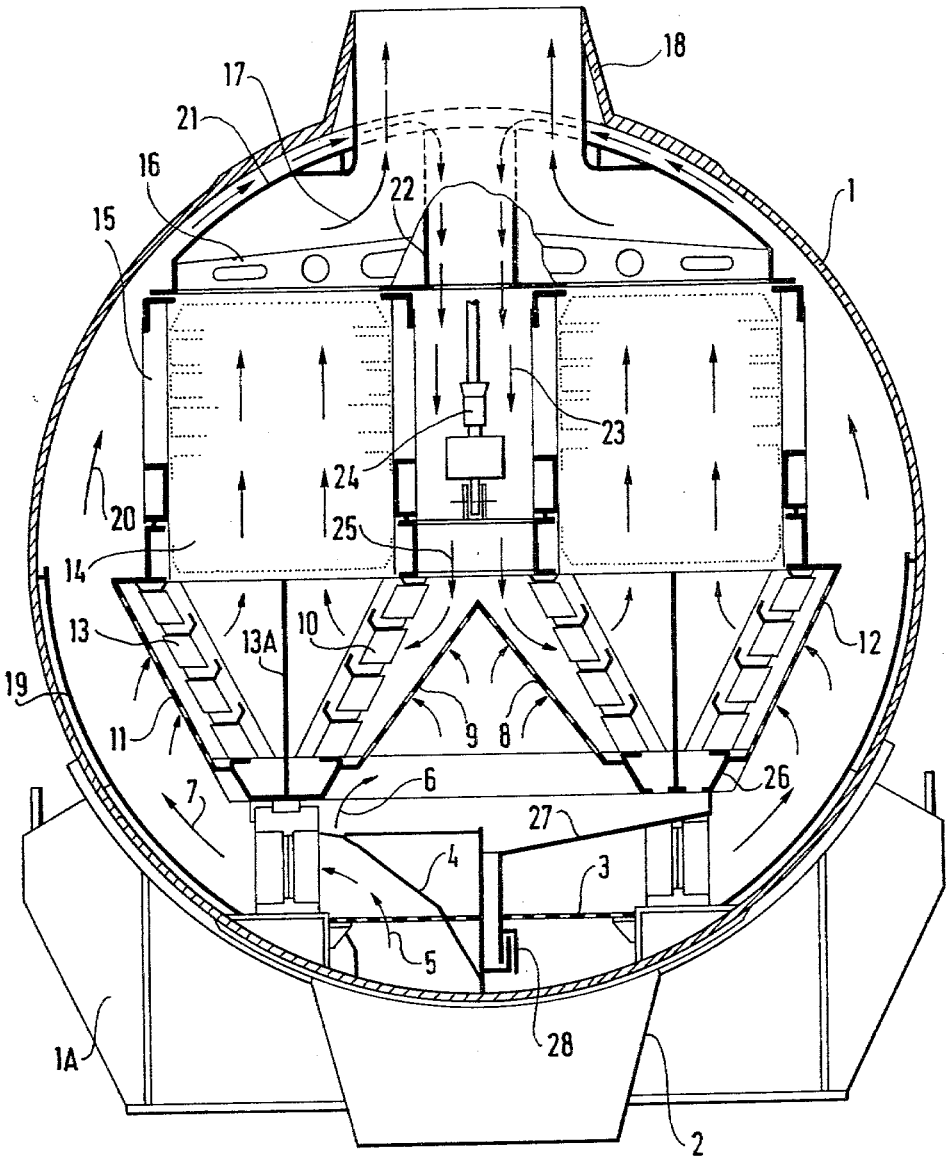
18
17
21
16
22
1
15
23
24
20
25
14
13
13A
10
12
19
11
9
8
7
6
26
27
4
3
5
28
1A
2

DEVICE FOR DRYING AND SUPERHEATING STEAM

The invention relates to a device for drying and superheating steam, in particular for supplying steam to a high power turbine, said device including, a cylindrical casing with a horizontal axis and further including the following, disposed inside the casing, parallel to said axis, and symmetrical about its longitudinal plane of symmetry:

a. in its lower portion, a pair of separator devices which remove the water from the water and steam emulsion which is to be superheated; and b. in its upper portion, a pair of detachable nests of tubes which constitute the superheaters.

In known horizontal axis superheating separators, the superheated steam in contact with the nests of superheating tubes rises in a sort of tunnel along the upper generatrix of the outer casing which contains the device as a whole, then it is removed via a pipe disposed in the centre of the device, near the load. Hence, near the upper generatrix, the outer casing is in contact with steam which is hotter than that with which it is in contact in its lower or middle portions. This causes an asymmetrical horizontal banana shape deformation which generates high stresses in the exchanger and is to be avoided as much as possible.

Preferred embodiments of the present invention remedy the above drawback and produce a device for drying and superheating steam, said device greatly reducing the asymmetrical deformation and in any case preventing the excessive stresses from being generated.

SUMMARY OF THE INVENTION

The device according to the invention is characterized in that it further includes members defining flow channels which allow part of the water and steam emulsion to rise on either side of the separators and of the superheaters near the inside surface of the casing, then to drop back between them to enter the inlets of the separators near to the plane of symmetry disposed parallel to said axis and symmetrically with respect to the plane of longitudinal symmetry.

Further, preferably its upper portion, above the superheaters includes a superheated steam chamber delimited by a cylindrical covering which is coaxial with the cylindrical casing, the gap between the cylindrical casing and said cylindrical covering forming, in said upper portion, the flow channels for said part of the water and steam emulsion which must flow in the vicinity of the inside surface of the casing.

BRIEF DESCRIPTION OF THE DRAWING

A device in accordance with the invention for drying and superheating steam for a power production plant is described hereinbelow by way of example and with reference to the FIGURE of the accompanying drawing.

The single FIGURE shows a transversal cross-section of the device through the wet steam inlet and the superheated steam outlet tubes, with a partial cutaway view in the zone of the tubes through which the fraction of wet steam drops out.

Further, the left half of the lower part of the FIGURE illustrates the cross-section at the wet steam inlet pipe and the right half illustrates an arrangement for removing the separated water to a draining device.

DESCRIPTION OF THE PREFERRED EMBODIMENTS

The heat exchanger includes a carbon steel outer casing 1 which rests on supports such as 1A. A wet steam inlet tube 2 leads to a horizontal grating 3. A deflector 4 deviates the flow of wet steam laterally in the direction of an arrow 5 so as to prevent the greater part of it from flowing towards the central zone of the separators. Part of the steam flows as shown by an arrow 6 towards the central zone and another part flows laterally as shown by an arrow 7. The wet steam flow from the central zone then passes through perforated metal sheets 8 and 9 which are inclined symmetrically with respect to the longitudinal plane of symmetry, which homogenize the distribution of the wet steam among spaced out rows of separators 10 and 13 constituted, for example, by stacks of parallel corrugated metal sheets.

The flow of wet steam which is a lateral flow runs along gratings 11 and 12 which distribute part of the flow among the spaced out rows of separators such as 10 and 13 which are disposed symmetrically (in a V configuration) with respect to vertical partitions such as 13A.

Nests of superheater tubes such as 14 are disposed above the drying units which are formed by the separators and the dry steam rises vertically between the superheater tubes. These nests of superheater tubes are held in frames such as 15 fixed by transversal beams 16. They are preferably bent hairpin-like and fixed at a longitudinal end of the device to perforated disks which delimit chambers for supplying steam at a higher pressure and for removing the condensed water.

Lastly, the superheated steam rises in the direction of arrows 17 towards the upper generatrix of the device, whence it is delivered towards the load, e.g. an expansion turbine, through tubes such as 18.

The lower half of the casing 1 in contact with the high-speed wet steam is equipped with an inner stainless steel coating to protect it from erosion and corrosion.

Part of the wet steam does not pass directly through the separators and superheaters, but rises along the inner wall of the casing as shown by an arrow 20, so as to keep the casing at a temperature which is not too high. To do this, the wet steam flows above the level of the superheaters between the casing 1 and a metal sheet 21 which delimits the superheated steam chamber and constitutes one member partially defining a flow channel for the wet steam. Since its speed is lower, the inner wall of the casing need no longer be coated with stainless steel. The wet steam then passes through tubes which pass through the passage taken by the superheated steam to reach the outlet tubes such as 18, and into central funnels such as 22 through which it drops down into the space 23 between the two series of nests of superheating tubes. Tie rods 24 for fixing the transversal beams 16 are provided in said space 23. Lastly, the wet steam flows along the path indicated by arrows 25 until it reaches the rows of separators such as 10, where it again meets the steam which has passed through the perforated metal sheets 8 and 9, the distance between these metal sheets and the separators being greater at their inlet zone, to take into account the extra discharge of steam.

The water trapped by the separators 10 flows towards the bottom of the latter and gathers in channels such as 26, whence it is brought through channels 27 to the centre of the lower portion of the casing.

It accumulates in draining system 28 whence it flows into draining units (not shown).

Although the embodiment of the device which has just been described with reference to the FIGURE appears to be preferable, it will be understood that various modifications can be made thereto without going beyond the scope of the invention, it being possible to replace some of its components by others which perform the same or an analogous function. In particular, the structures of the separators and of the nests of superheater tubes and the method of removal of the separated water may be different.

The invention applies in a particularly advantageous way to drying and superheating steam which comes from an expansion turbine of a large power production plant before said steam is sent to a lower pressure turbine. But it is suitable for any installation in which it is required to dry and superheat steam before sending it to the load.

We claim:

1. A device for drying and superheating steam, in particular for supplying steam to a high power turbine, said device including a cylindrical casing having a horizontal axis, a wet steam inlet opening to the bottom of said cylindrical casing, a superheated steam outlet opening to the top of said casing, said device further including the following disposed, inside the casing, parallel to said axis, and symmetrical about its longitudinal plane of symmetry:

a. in its lower portion, a pair of separator devices which remove the water from the water and steam emulsion which is to be superheated; and b. in its upper portion; a pair of nests of tubes which constitute the superheaters, the improvement wherein said device further comprises members forming with said casing lateral channels allowing part of the water-steam emulsion to rise on either side of the separators and the superheaters near the inside surface of the casing, tubes passing to the outlet passage for the superheated steam and connecting said lateral channels with central funnels, said central funnels being connected with the inlet of the separator devices near the plane of symmetry allowing part of the steam-water emulsion to fall into the space between the nests of superheater tubes downwardly to said inlet of said separator devices.

2. A device according to claim 1, wherein in its upper portion, above the superheaters, said device includes a superheated steam chamber enclosed by a cylindrical covering coaxial with said cylindrical casing, and partially forming therewith said lateral channels and defining a gap forming the upper part of said lateral channels near said tubes passing through the outlet passage for the superheated steam and connecting the lateral channels with said central funnels.

* * * * *